US005765317A

United States Patent [19]

Mast

[11] Patent Number: 5,765,317

[45] Date of Patent: Jun. 16, 1998

[54] STRUCTURALLY INTEGRATED SHELF AND SOFFIT CONFIGURATION

[76] Inventor: Daniel Ray Mast, Rt. 10, Box 149, Crossville, Tenn. 38555-8910

[21] Appl. No.: 794,949

[22] Filed: Feb. 4, 1997

[51] Int. Cl.[6] ..... E04D 7/04

[52] U.S. Cl. ..... 52/93.2; 52/92.1; 52/262; 52/283

[58] Field of Search ..... 52/22, 90.1, 92.1, 52/92.2, 92.3, 93.1, 93.2, 94–96, 262, 283

[56] References Cited

U.S. PATENT DOCUMENTS

| | | | |
|---|---|---|---|
| 3,683,785 | 8/1972 | Grange | 52/92.1 X |
| 3,972,164 | 8/1976 | Grange | 52/92.1 X |
| 4,096,670 | 6/1978 | Fuller | 52/92.2 |
| 5,099,622 | 3/1992 | Sutton | 52/22 X |
| 5,501,043 | 3/1996 | Park | 52/92.1 |

*Primary Examiner*—Beth A. Aubrey

[57] ABSTRACT

A structurally integrated shelf and soffit configuration is provided for storage buildings and sheds. A shelf board extends inward and outward across the top wall plate and a soffit board is affixed to the outside underside of said shelf board. The soffit board gives a finished appearance and provides support for the cornice fascia truss. The shelf provides a substantial amount of additional storage area. This configuration provides lateral structural rigidity to withstand the outward pressures exerted by a domed or gambrel roof.

3 Claims, 4 Drawing Sheets

STRUCTURALLY INTEGRATED SHELF AND SOFFIT CONFIGURATION

BACKGROUND OF THE INVENTION

The instant invention relates generally to soffit roof overhang configurations, and more particularly, to soffit roof overhang configurations of small storage buildings and sheds.

Numerous soffit roof overhang configurations have been provided in the prior art. While these configurations may have been suitable in the particular application, the present invention provides distinct advantages as hereafter described.

SUMMARY OF THE INVENTION

A primary object of the present invention is to provide an improved soffit roof overhang design for storage buildings.

More particularly, it is the object of the present invention to provide a useful storage shelf area for the stowage of various items, objects, and tools.

Another object is to provide this storage shelf area at little or even less cost to the builder or manufacturer as compared to prior art.

A still further object is to provide great lateral structural rigidity to withstand the outward pressures exerted by rafters; especially, but not limited to, rafters of a domed or gambrel roof.

Still yet another object is to provide a simple design whereby the soffit board extends past the corner of the building to support the cornice fascia rafter.

Further objects will become evident as the description proceeds.

This invention may be embodied in the form illustrated in the accompanying drawings. Remember, however, that changes may be made in the specific construction within the scope of the specified claims.

BRIEF DESCRIPTION OF THE DRAWING FIGURES

Figure 1:
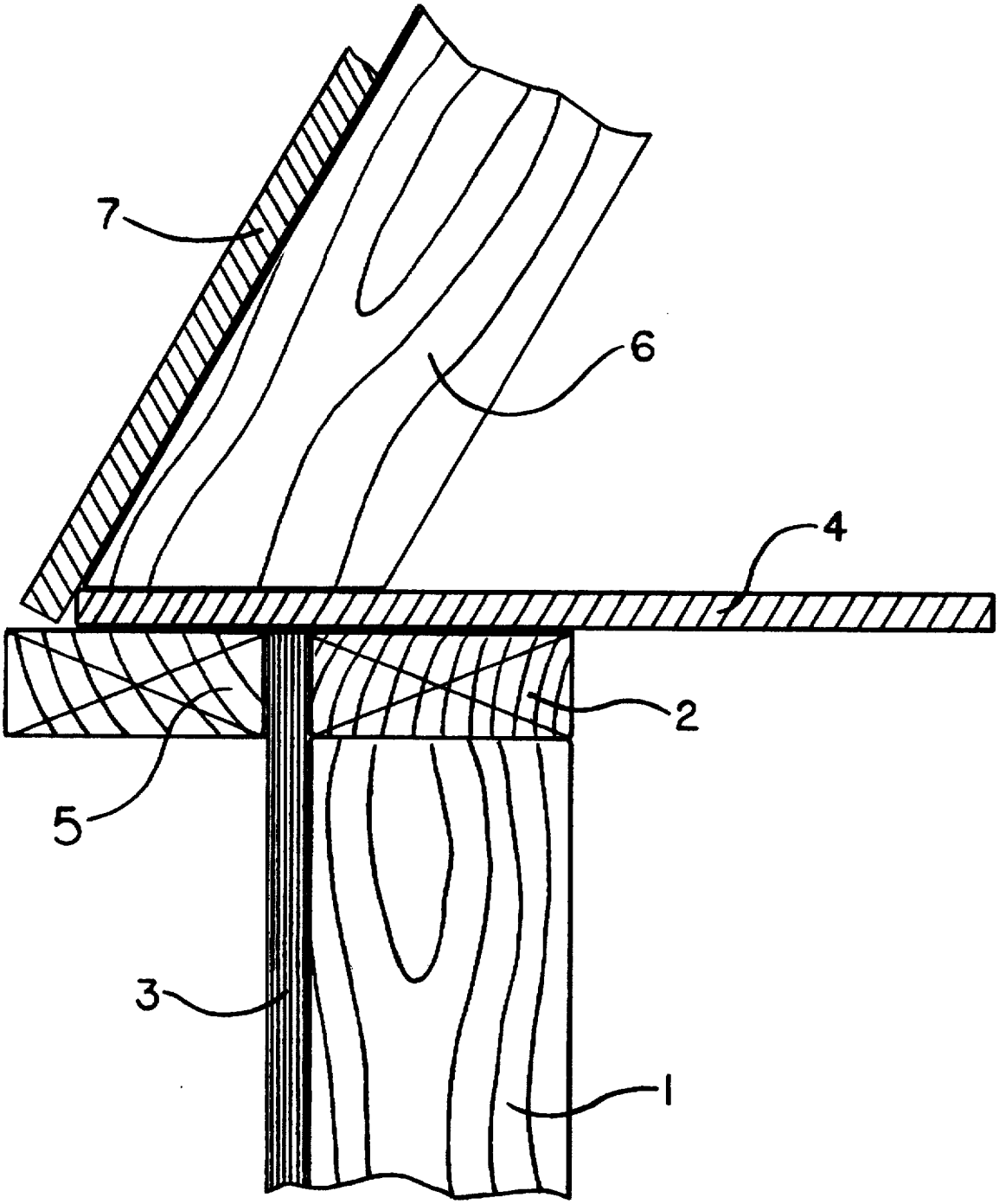
FIG. 1 is a cross sectional view of the structurally integrated soffit and shelf configuration.

List of Reference Numerals Used in the Drawings

1—WALL STUD
2—WALL TOP PLATE
3—EXTERIOR SIDING
4—SHELF BOARD
5—SOFFIT BOARD
6—RAFTER
7—ROOF SHEATHING

8—CORNICE FASCIA RAFTER
9—ROOF SHEATHING THAT DOUBLES AS THE CORNICE
10—FASTENERS
11—CORNER TRIM BOARDS
12—ROOF DRIP EDGE

DETAILED DESCRIPTION OF THE PREFERED EMBODIMENTS

Figure 2:
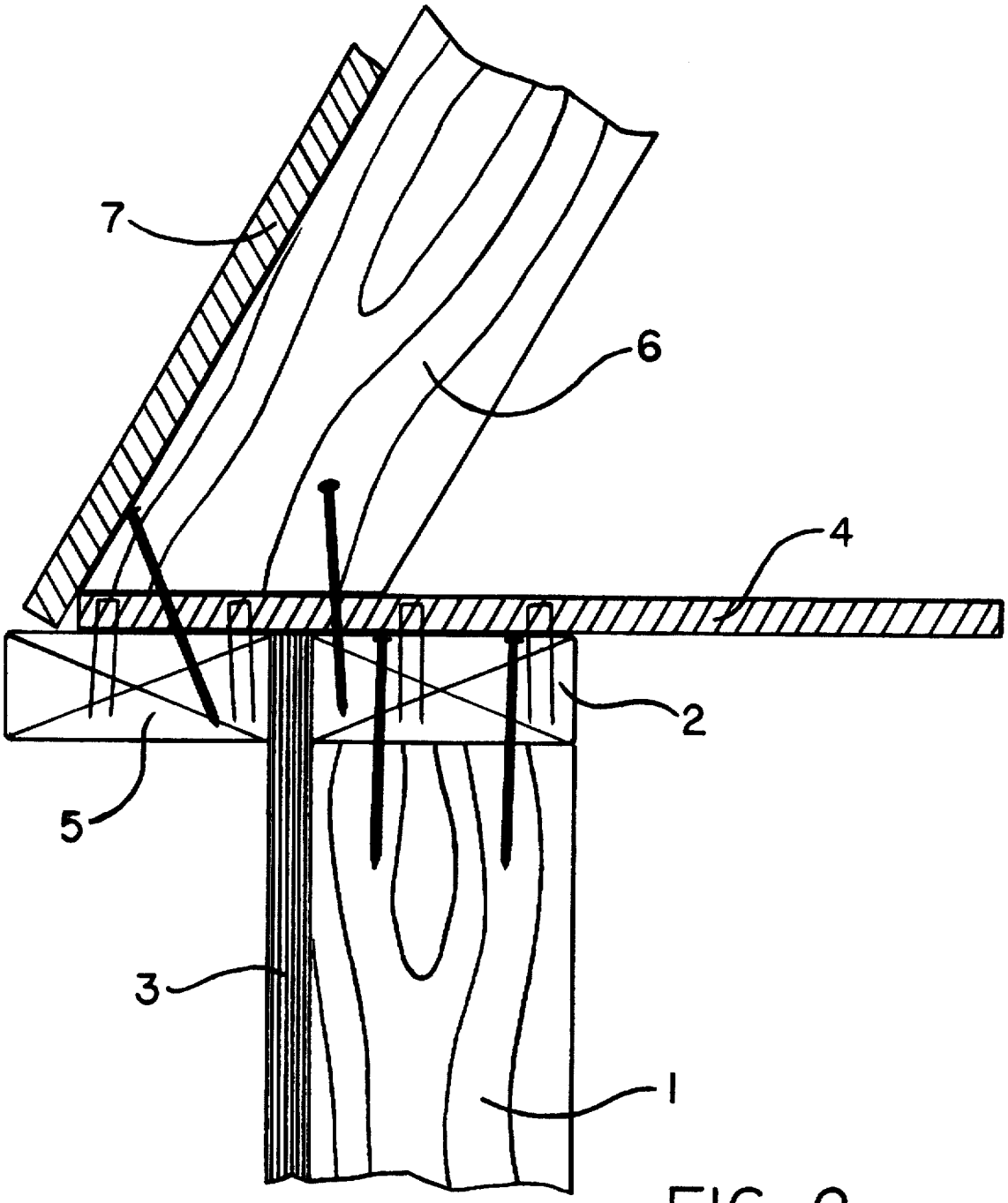
FIG. 2 is a cross sectional view to show fasteners.

Referring now to FIG. 1 and FIG. 2: Reference numerals 1, 2, and 3 constitute the side wall assembly in which the wall plate 2 is secured to the wall stud 1; to which exterior siding 3 is then attached.

The present invention provides for a shelf board 4 to be secured to the top wall plate 2 by the use of nails, staples, or other appropriate fasteners, as shown in FIG. 2. This shelf board 4 may be plywood, Oriented Strand Board, or similar product, and, when installed, extends inward and outward from the wall plate 2, providing a useful storage area.

The rafter 6 is affixed to the upper surface of the outer end of the shelf board 4. Roof sheathing 7 and/or other suitable roofing materials are applied to this rafter 6.

If desired, a soffit board 5 may be secured to the lower surface of the outer end of the shelf board 4 using appropriate fasteners as in FIG. 2. This provides a neat, finished exterior appearance, a more substantial nailing surface on which to affix rafter 6, and a small ledge to ease positioning and mounting of roof sheathing 7.

Figure 3:
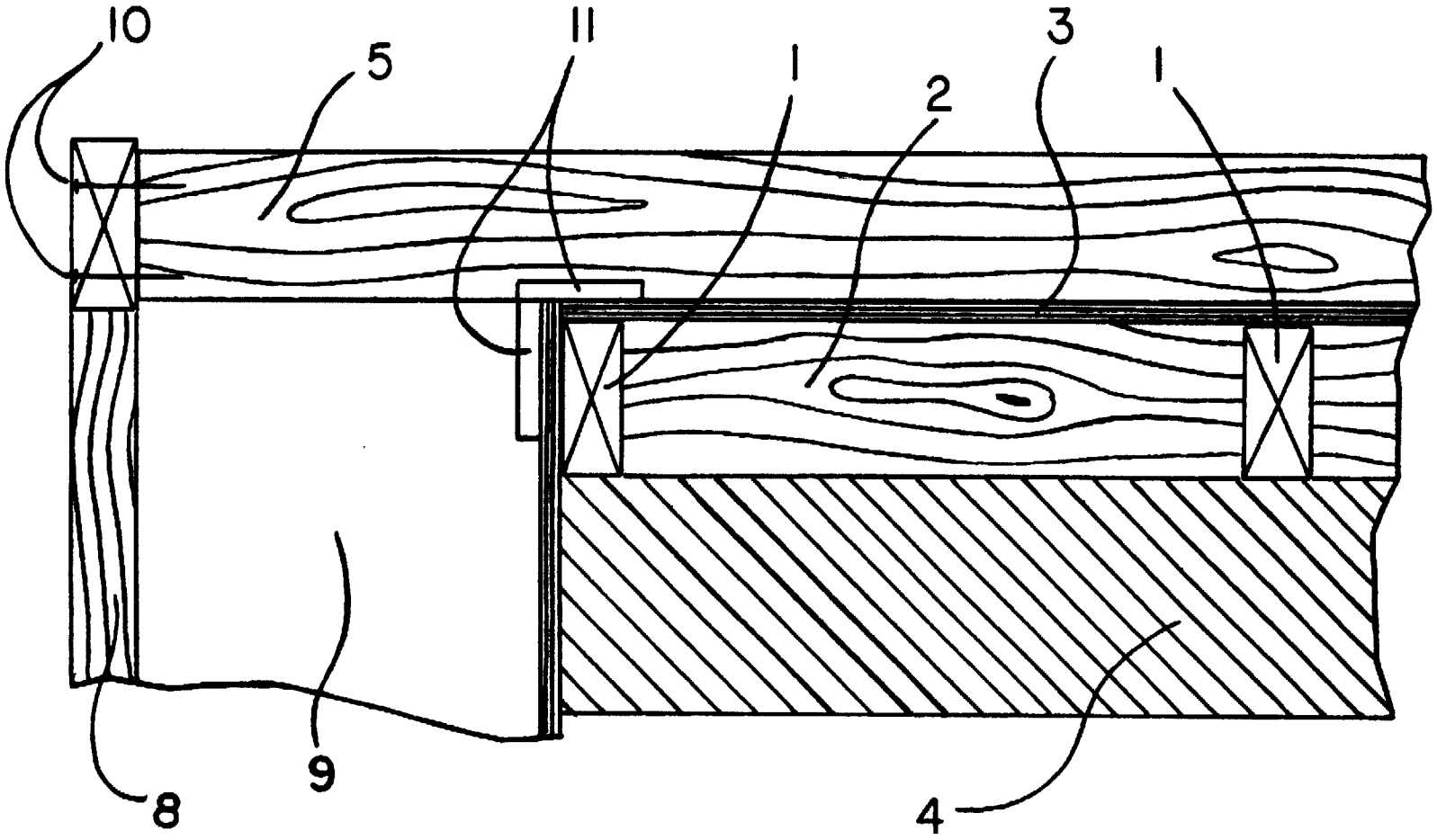
FIG. 3 is a bottom view of the present invention showing how the soffit board extends past the corner of the building to accommodate and support the cornice fascia rafter.
Figure 4:
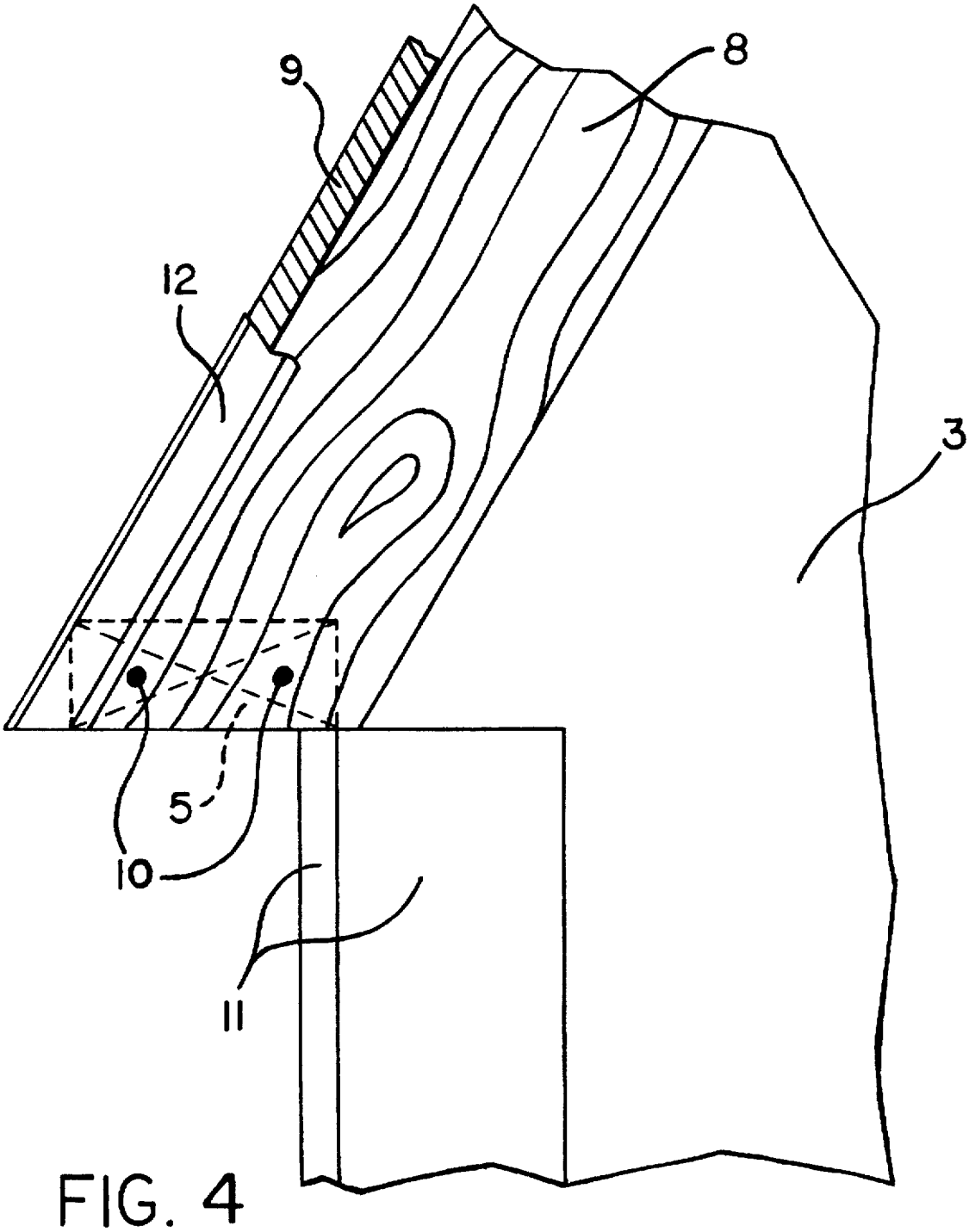
FIG. 4 is a front view showing the cornice fascia rafter and how it is secured to the extended soffit board.

The soffit board 5 can then, if so desired, be extended past the corner of the building, as in FIG. 3, to support the cornice fascia rafter 8; which is secured by fasteners 10 as illustrated in FIG. 3 and FIG. 4.

While this invention has been described and illustrated, it will be understood that various substitutions and changes in detail can be made without departing from the spirit of the invention.

What is claimed is:

1. A shed comprising a substantially vertical wall stud having an interior surface, an exterior surface opposite the interior surface, and a top surface, a wall plate having a top surface and a bottom surface, the wall plate having a top surface and a bottom surface, the bottom surface of the wall plate mounted on the top surface of the wall stud, a shelf board having an inner end, an outer end opposite the inner end, an upper surface and a lower surface, the lower surface mounted on the top surface of the wall plate, the outer end of the shelf board extending beyond the exterior surface of the wall stud, the inner end of the shelf board extending beyond the interior surface of the wall stud, and rafters affixed to and extending away from the upper surface of the outer end of the shelf board.

2. The shed as claimed in claim 1, further comprising a soffit board affixed to the lower surface of the outer end of the shelf board.

3. The shed as claimed in claim 2, further comprising a cornice fascia rafter, the soffit board contacting and supporting the cornice fascia rafter.

* * * * *